US009782866B1

(12) United States Patent
Xue et al.

(10) Patent No.: US 9,782,866 B1
(45) Date of Patent: Oct. 10, 2017

(54) ONLINE BURR REMOVING DEVICE FOR WHEEL

(71) Applicant: CITIC Dicastal CO.,LTD, Qinhuangdao (CN)

(72) Inventors: Bowen Xue, Qinhuangdao (CN); Haiping Chang, Qinhuangdao (CN); Jiandong Guo, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 0 days.

(21) Appl. No.: 15/423,721

(22) Filed: Feb. 3, 2017

(30) Foreign Application Priority Data

Sep. 24, 2016 (CN) ..... 2016 1 0845440

(51) Int. Cl.
*B24B 9/04* (2006.01)
*B08B 1/00* (2006.01)
*B08B 1/04* (2006.01)

(52) U.S. Cl.
CPC ..... *B24B 9/04* (2013.01); *B08B 1/002* (2013.01); *B08B 1/04* (2013.01)

(58) Field of Classification Search
CPC ..... B24B 9/04
See application file for complete search history.

(56) References Cited

U.S. PATENT DOCUMENTS 4,993,097 A * 2/1991 D'Amato ..... B23Q 15/12 15/102
5,600,861 A * 2/1997 Saito ..... A46B 13/008 15/21.1
2016/0353873 A1* 12/2016 Xue ..... A46B 13/02
2016/0354891 A1* 12/2016 Xue ..... B24B 5/44

* cited by examiner

*Primary Examiner* — Randall Chin
(74) *Attorney, Agent, or Firm* — Calfee, Halter & Griswold LLP

(57) ABSTRACT

The present invention provides an improved online burr removing device for a wheel. When the device is used, equal rotating speeds of the inner brush and the outer brush can be realized by using one driving motor, thereby avoiding the problem that the linear speed is low in the center but high at the outer edge when an integrated brush rotates at the same angle; meanwhile, the device has the characteristics of high automation degree, advanced process, simple structure and high safety and stability.

1 Claim, 2 Drawing Sheets

ONLINE BURR REMOVING DEVICE FOR WHEEL

CROSS-REFERENCE TO RELATED APPLICATIONS

This application claims priority to Chinese Patent Application No. 201610845440.6, filed on Sep. 24, 2016, which is hereby incorporated by reference in its entirety.

TECHNICAL FIELD

The present invention relates to a burr removing device for a wheel.

BACKGROUND ART

Burrs are always produced on the cutter outlet side of a workpiece in the machining process of an aluminum alloy wheel due to the friction between the cutter and the workpiece, and the burrs must be removed timely, cleanly and effectively, otherwise it will directly influence the following coating effect. At present, the burr removing method in the industry is to brush burrs on the back cavity with a large disc brush on special equipment. When the brush rotates at certain angular speed, the linear speed of its edge is often much higher than that of its center, and if the burrs at the root of a flange are well disposed, the burrs at the edge will be disposed excessively, leading to a very contradictory problem. There is no effective equipment in the industry for solving the current situation.

SUMMARY OF THE INVENTION

The objective of the present invention is to provide an improved online burr removing device for a wheel. The device can realize equal rotating speed of an inner brush and an outer brush by using one driving motor.

In order to fulfill the above objective, the present invention adopts the technical solution: the improved online burr removing device for a wheel, comprises a frame, a driving motor, lifting cylinders, guide posts I, guide sleeves I, a fixed plate, a lower lifting plate, a transition sleeve, a small bearing seat, a shaft I, a large bearing seat, a gear ring, pinions, shafts II, a gearwheel, a shaft III, a pressing sleeve, an outer brush, an inner brush, V-shaped rollers, left shafts, left bearing seats, a left slide plate, a guide rail I, an upper lifting plate, guide posts II, guide sleeves II, racks, synchronous gears, a servo electric cylinder, a servo motor, a right slide plate, a clamping cylinder, right bearing seats, a right shaft, roller beds, supports, a guide rail II, a translation cylinder and a platform. The two lifting cylinders and the four guide sleeves I are fixed on the fixed plate; the four guide posts I matched with the four guide sleeves I are installed below the lower lifting plate, and the output ends of the lifting cylinders are also articulated with the lower part of the lower lifting plate; the driving motor is fixed below the lower lifting plate via a flange; the small bearing seat is fixed on the lower lifting plate; the transition sleeve is also fixed on the lower lifting plate and arranged outside the small bearing seat; the gearwheel is installed on the shaft I, the shaft I is installed inside the small bearing seat via a bearing; the large bearing seat is fixed above the transition sleeve; the shaft III is installed inside the large bearing seat via a bearing; the gear ring is fixed inside the shaft III; the four shafts II are fixed at the bottom of the shaft III; the four pinions are installed on the four shafts II via bearings, and are simultaneously engaged with the gear ring and the gearwheel; the pressing sleeve is installed above the gearwheel; and the outer brush and the inner brush are respectively installed at the top of the shaft III and the shaft I.

Two V-shaped rollers are installed below the two left shafts, and are installed inside the left bearing seats via bearings; the two left bearing seats are fixed on the left slide plate; the left slide plate is installed below the upper lifting plate via the guide rail I; the four guide posts II are fixed on the upper lifting plate, and the four guide sleeves II matched with the four guide posts II are fixed at the top of the frame; the servo electric cylinder is also fixed at the top of the frame, and the output end of the servo electric cylinder is articulated with the upper part of the upper lifting plate; two V-shaped rollers are also installed below the right shaft, and are installed inside the right bearing seats via bearings; the two right bearing seats are fixed on the right slide plate; the right slide plate is installed below the upper lifting plate via the guide rail I; the servo motor is fixed on the right slide plate, and the output end of the servo motor is connected with the right shaft; the clamping cylinder is fixed on the side of the upper lifting plate, and the output end of the clamping cylinder is connected with the right slide plate; two racks are respectively fixed on the left slide plate and the right slide plate, and are engaged with the two synchronous gears installed below the upper lifting plate.

Online roller bed parts include: a plurality of roller beds are installed above the supports; the supports are installed above the platform via the guide rail II; the translation cylinder is fixed on the side of the frame, and the output end of the translation cylinder is connected with the lower part of the support. The device is composed of a left online roller bed part and a right online roller bed part.

In actual use, the servo electric cylinder adjusts the heights of the four V-shaped rollers via the guide posts II according to the height of the wheel; the clamping cylinder enables the four V-shaped rollers to clamp the upper rim of the wheel via the racks and the synchronous gears; the servo motor enables the clamped wheel to rotate; meanwhile, the translation cylinder enables the supports and the roller beds on the left and right parts to move to two sides respectively via the guide rail II; the driving motor drives the inner brush and the gearwheel to rotate via the shaft I and simultaneously drives the shaft III and the outer brush to rotate via the pinions and the gear ring, and the rotating speeds of the inner brush and the outer brush are equal via an appropriate drive ratio; the lifting cylinders enable the inner brush and the outer brush to rise via the four guide posts I, and burrs can be removed when the inner brush and the outer brush contact the back cavity of the wheel.

In the present invention, equal rotating speeds of the inner brush and the outer brush can be realized by using one driving motor in use, thereby avoiding the problem that the linear speed is low in the center but high at the outer edge when an integrated brush rotates at the same angle; meanwhile, the device has the characteristics of high automation degree, advanced process, simple structure and high safety and stability.

Figure 1:
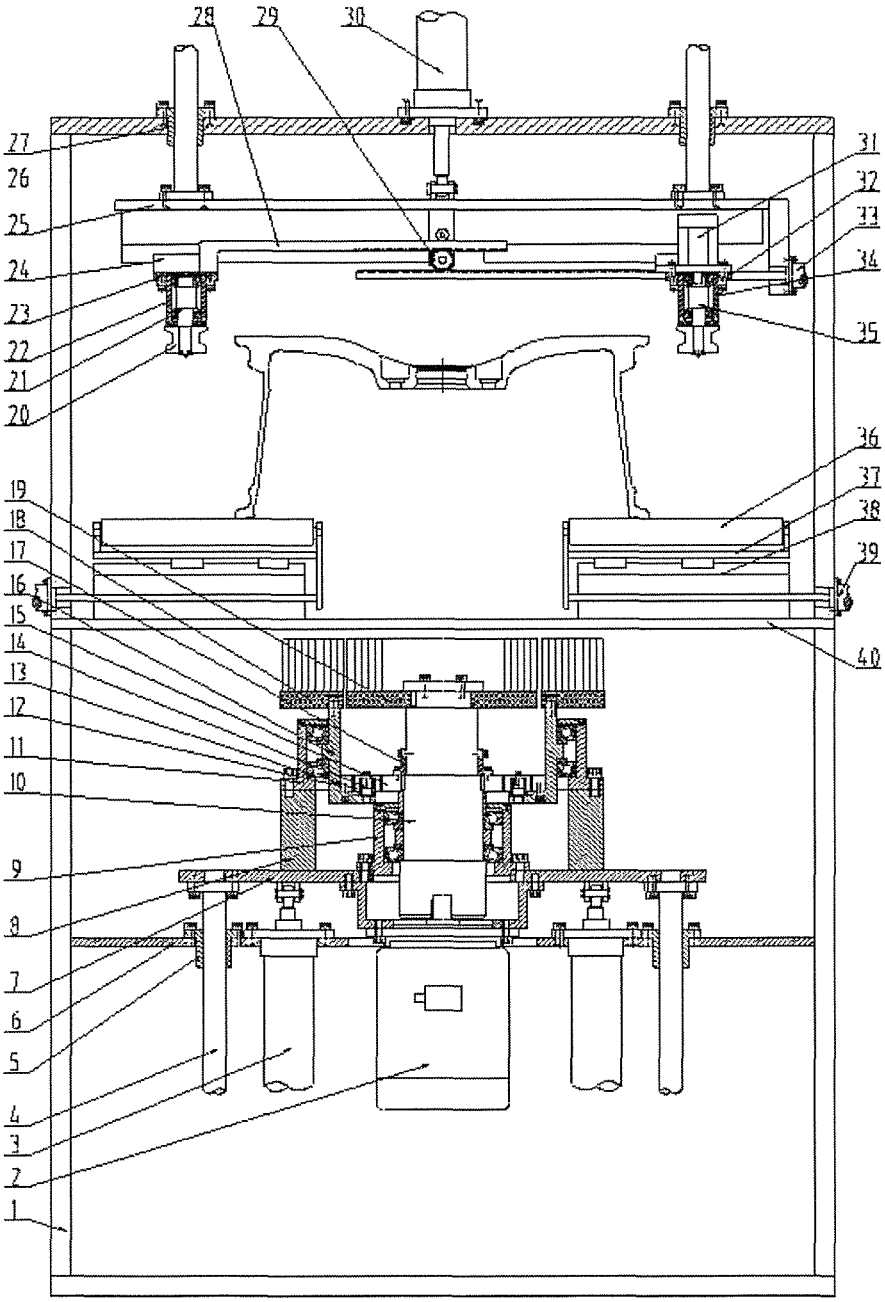
FIG. 1 is a front view of an improved online burr removing device for a wheel of the present invention.
Figure 2:
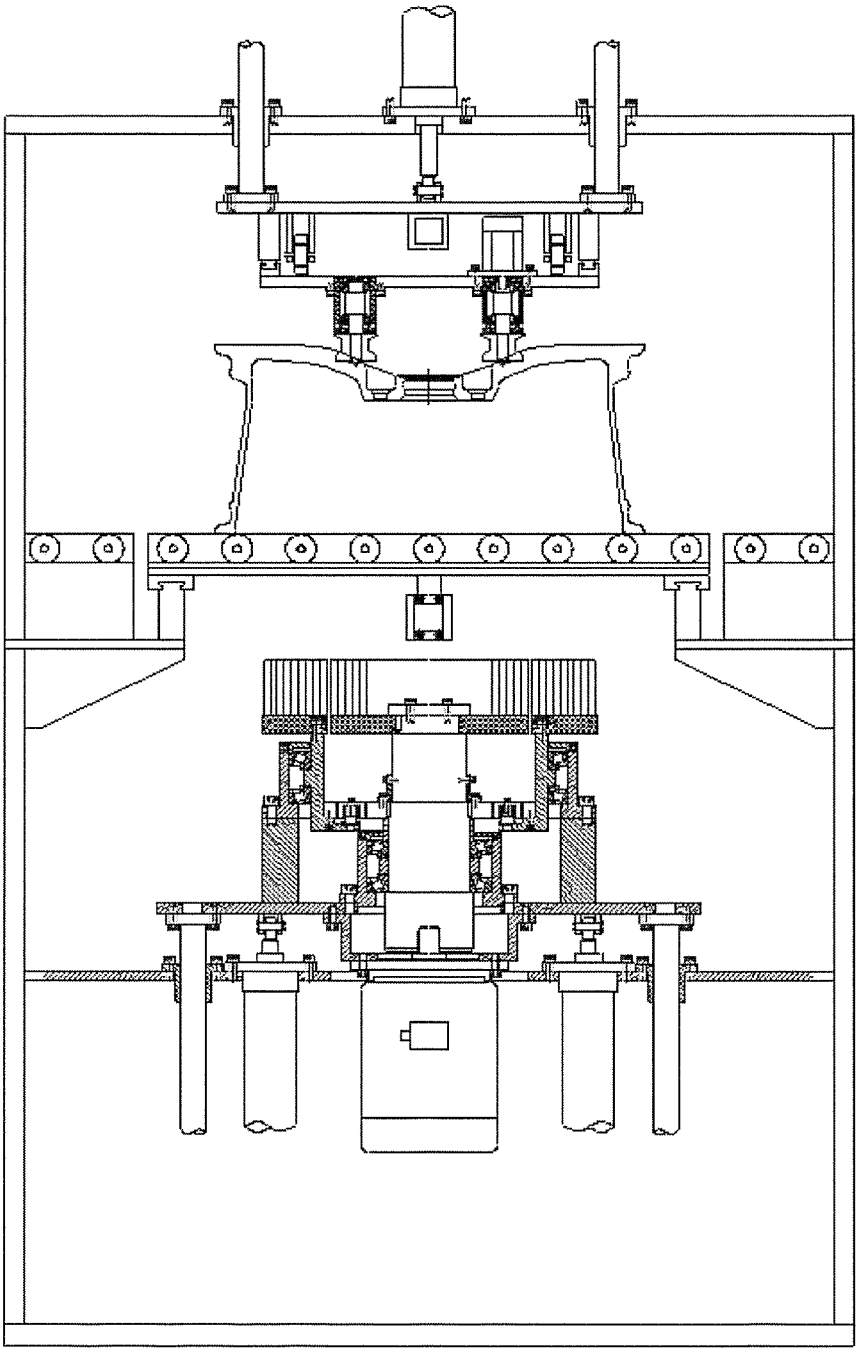
FIG. 2 is a left view of the improved online burr removing device for a wheel of the present invention.

In figures: 1—frame, 2—driving motor, 3—lifting cylinder, 4—guide post I, 5—guide sleeve I, 6—fixed plate, 7—lower lifting plate, 8—transition sleeve, 9—small bearing seat, 10—shaft I, 11—large bearing seat, 12—gear ring, 13—pinion, 14—shaft II, 15—gearwheel, 16—shaft III, 17—pressing sleeve, 18—outer brush, 19—inner brush, 20—V-shaped roller, 21—left shaft, 22—left bearing seat, 23—left slide plate, 24—guide rail I, 25—upper lifting plate, 26—guide post II, 27—guide sleeve II, 28—rack, 29—synchronous gear, 30—servo electric cylinder, 31—servo motor, 32—right slide plate, 33—clamping cylinder, 34—right bearing seat, 35—right shaft, 36—roller bed, 37—support, 38—guide rail II, 39—translation cylinder, 40—platform.

DETAILED DESCRIPTION OF THE INVENTION

Details and working conditions of a specific device provided by the present invention will be described below in combination with the accompanying drawings.

The device comprises a frame 1, a driving motor 2, lifting cylinders 3, guide posts I 4, guide sleeves I 5, a fixed plate 6, a lower lifting plate 7, a transition sleeve 8, a small bearing seat 9, a shaft I 10, a large bearing seat 11, a gear ring 12, pinions 13, shafts II 14, a gearwheel 15, a shaft III 16, a pressing sleeve 17, an outer brush 18, an inner brush 19, V-shaped rollers 20, left shafts 21, left bearing seats 22, a left slide plate 23, a guide rail I 24, an upper lifting plate 25, guide posts II 26, guide sleeves II 27, racks 28, synchronous gears 29, a servo electric cylinder 30, a servo motor 31, a right slide plate 32, a clamping cylinder 33, right bearing seats 34, a right shaft 35, roller beds 36, supports 37, a guide rail II 38, a translation cylinder 39 and a platform 40. The two lifting cylinders 3 and the four guide sleeves I 5 are fixed on the fixed plate 6; the four guide posts I 4 matched with the four guide sleeves I 5 are installed below the lower lifting plate 7, and the output ends of the lifting cylinders 3 are also articulated with the lower part of the lower lifting plate 7; the driving motor 2 is fixed below the lower lifting plate 7 via a flange; the small bearing seat 9 is fixed on the lower lifting plate 7; the transition sleeve 8 is also fixed on the lower lifting plate 7 and arranged outside the small bearing seat 9; the gearwheel 15 is installed on the shaft I 10, the shaft I 10 is installed inside the small bearing seat 9 via a bearing; the large bearing seat 11 is fixed above the transition sleeve 8; the shaft III 16 is installed inside the large bearing seat 11 via a bearing; the gear ring 12 is fixed inside the shaft III 16; the four shafts II 14 are fixed at the bottom of the shaft III 16; the four pinions 13 are installed on the four shafts II 14 via bearings, and are simultaneously engaged with the gear ring 12 and the gearwheel 15; the pressing sleeve 17 is installed above the gearwheel 15; and the outer brush 18 and the inner brush 19 are respectively installed at the tops of the shaft III 16 and the shaft I 10.

Two V-shaped rollers 20 are installed below the two left shafts 21, and are installed inside the left bearing seats 22 via bearings; the two left bearing seats 22 are fixed on the left slide plate 23; the left slide plate 23 is installed below the upper lifting plate 25 via the guide rail I 24; the four guide posts II 26 are fixed on the upper lifting plate 25, and the four guide sleeves II 27 matched with the four guide posts II 26 are fixed at the top of the frame 1; the servo electric cylinder 30 is also fixed at the top of the frame 1, and the output end of the servo electric cylinder 30 is articulated with the upper part of the upper lifting plate 25; two V-shaped rollers 20 are also installed below the right shaft 35, and are installed inside the right bearing seats 34 via bearings; the two right bearing seats 34 are fixed on the right slide plate 32; the right slide plate 32 is installed below the upper lifting plate 25 via the guide rail I 24; the servo motor 31 is fixed on the right slide plate 32, and the output end of the servo motor 31 is connected with the right shaft 35; the clamping cylinder 33 is fixed on the side of the upper lifting plate 25, and the output end of the clamping cylinder 33 is connected with the right slide plate 32; two racks 28 are respectively fixed on the left slide plate 23 and the right slide plate 32, and are engaged with the two synchronous gears 29 installed below the upper lifting plate 25.

Online roller bed parts include: a plurality of roller beds 36 are installed above the supports 37; the supports 37 are installed above the platform 40 via the guide rail II 38; the translation cylinder 39 is fixed on the side of the frame 1, and the output end of the translation cylinder 39 is connected with the lower part of the support 37. The device is composed of a left online roller bed part and a right online roller bed part.

In actual use, the servo electric cylinder 30 adjusts the heights of the four V-shaped rollers 20 via the guide posts II 26 according to the height of a wheel; the clamping cylinder 33 enables the four V-shaped rollers 20 to clamp the upper rim of the wheel via the racks 28 and the synchronous gears 29; the servo motor 31 enables the clamped wheel to rotate; meanwhile, the translation cylinder 39 enables the supports 37 and the roller beds 36 on the left and right parts to move to two sides respectively via the guide rail II 38; the driving motor 2 drives the inner brush 19 and the gearwheel 15 to rotate via the shaft I 10 and simultaneously drives the shaft III 16 and the outer brush 18 to rotate via the pinions 13 and the gear ring 12, and the rotating speeds of the inner brush 19 and the outer brush 18 are equal via an appropriate drive ratio; the lifting cylinders 3 enable the inner brush 19 and the outer brush 18 to rise via the four guide posts I 4, and burrs can be removed when the inner brush 19 and the outer brush 18 contact the back cavity of the wheel.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An improved online burr removing device for a wheel, comprising a frame, a driving motor, two lifting cylinders, four guide posts I, four guide sleeves I, a fixed plate, a lower lifting plate, a transition sleeve, a small bearing seat, a shaft I, a large bearing seat, a gear ring, four pinions, four shafts II, a gearwheel, a shaft III, a pressing sleeve, an outer brush, an inner brush, four V-shaped rollers, two left shafts, two left bearing seats, a left slide plate, a guide rail I, an upper lifting plate, four guide posts II, four guide sleeves II, two racks, two synchronous gears, a servo electric cylinder, a servo motor, a right slide plate, a clamping cylinder, two right bearing seats, two right shafts, and two online roller bed parts, wherein the two lifting cylinders and the four guide sleeves I are fixed on the fixed plate; the four guide posts I match with the four guide sleeves I, and are installed below the lower lifting plate, and the output ends of the lifting cylinders are also articulated with the lower part of the lower lifting plate; the driving motor is fixed below the lower lifting plate via a flange; the small bearing seat is fixed on the lower lifting plate; the transition sleeve is also fixed on the lower lifting plate and arranged outside the small bearing seat; the gearwheel is installed on the shaft I, the shaft I is installed inside the small bearing seat via a bearing; the large bearing seat is fixed above the transition sleeve; the shaft III is installed inside the large bearing seat via a bearing; the gear ring is fixed inside the shaft III; the four shafts II are fixed at the bottom of the shaft III; the four pinions are installed on the four shafts II via bearings, and are simultaneously engaged with the gear ring and the gearwheel; the pressing sleeve is installed above the gearwheel; the outer brush and the inner brush are respectively installed at the tops of the shaft III and the shaft I;

two of the four V-shaped rollers are installed below the two left shafts, and are installed inside the left bearing seats via bearings; the two left bearing seats are fixed on the left slide plate; the left slide plate is installed below the upper lifting plate via the guide rail I; the four guide posts II are fixed on the upper lifting plate, and the four guide sleeves II matched with the four guide posts II are fixed at the top of the frame; the servo electric cylinder is also fixed at the top of the frame, and the output end of the servo electric cylinder is articulated with the upper part of the upper lifting plate; the other two of the four V-shaped rollers are also installed below the two right shafts, and are installed inside the right bearing seats via bearings; the two right bearing seats are fixed on the right slide plate; the right slide plate is installed below the upper lifting plate via the guide rail I; the servo motor is fixed on the right slide plate, and the output end of the servo motor is connected with the right shaft; the clamping cylinder is fixed on the side of the upper lifting plate, and the output end of the clamping cylinder is connected with the right slide plate; two racks are respectively fixed on the left slide plate and the right slide plate, and are engaged with the two synchronous gears installed below the upper lifting plate;

one of the two online roller bed parts comprises a roller bed, a support, a guide rail II, a translation cylinder and a platform, the roller bed is installed above the support; the support is installed above the platform via the guide rail II; the translation cylinder is fixed on the side of the frame, and the output end of the translation cylinder is connected with the lower part of the support.

* * * * *